US007213710B2

(12) United States Patent
Cotert

(10) Patent No.: US 7,213,710 B2
(45) Date of Patent: May 8, 2007

(54) PACKAGE FOR COMPRESSIBLE FLAT ARTICLES

(75) Inventor: Filiz Cotert, Frankfurt am Main (DE)

(73) Assignee: The Procter & Gamble Company, Cincinnati, OH (US)

( * ) Notice: Subject to any disclaimer, the term of this patent is extended or adjusted under 35 U.S.C. 154(b) by 7 days.

(21) Appl. No.: 10/877,542

(22) Filed: Jun. 25, 2004

(65) Prior Publication Data

US 2004/0232029 A1 Nov. 25, 2004

Related U.S. Application Data

(63) Continuation of application No. PCT/US2004/015322, filed on May 13, 2004.

(51) Int. Cl.
*B65D 71/06* (2006.01)

(52) U.S. Cl. ..... 206/494; 383/207; 221/302

(58) Field of Classification Search ..... 206/233, 206/494, 440, 438, 449, 812; 383/66, 203, 383/205, 207, 208, 209; 221/302, 309
See application file for complete search history.

(56) References Cited

U.S. PATENT DOCUMENTS

| | | | | | |
|---|---|---|---|---|---|
| 1,306,224 | A | * | 6/1919 | Godley | 229/313 |
| 3,652,008 | A | * | 3/1972 | Grotefend | 229/313 |
| 4,192,420 | A | * | 3/1980 | Worrell et al. | 206/205 |
| 4,420,080 | A | * | 12/1983 | Nakamura | 206/449 |
| 4,552,269 | A | * | 11/1985 | Chang | 383/211 |
| 4,610,357 | A | * | 9/1986 | Nakamura | 206/449 |
| 4,679,693 | A | * | 7/1987 | Forman | 383/203 |
| 4,739,879 | A | * | 4/1988 | Nakamura | 206/205 |
| 4,848,575 | A | * | 7/1989 | Nakamura et al. | 206/449 |
| 5,022,216 | A | | 6/1991 | Muckenfuhs et al. | |
| 5,065,868 | A | | 11/1991 | Cornelissen et al. | |
| 5,163,558 | A | * | 11/1992 | Palumbo et al. | 206/494 |
| 5,409,116 | A | * | 4/1995 | Aronsen | 206/484 |
| 5,908,246 | A | | 6/1999 | Arimura et al. | |
| 6,113,271 | A | * | 9/2000 | Scott et al. | 383/211 |
| 6,126,009 | A | | 10/2000 | Shiffler et al. | |
| 6,698,928 | B2 | * | 3/2004 | Miller | 383/205 |

FOREIGN PATENT DOCUMENTS

| | | | |
|---|---|---|---|
| CH | 325095 | A | 12/1957 |
| DE | 35 42 999 | A1 | 8/1986 |
| DE | 29719685 | | 5/1999 |
| EP | 0 406 928 | B1 | 1/1991 |
| EP | 0517566 | B1 | 12/1992 |
| EP | 0 585 653 | A1 | 3/1994 |
| EP | 0 942 881 | B1 | 9/1999 |
| JP | 61-203355 | A | 9/1986 |
| JP | 3256848 | A | 11/1991 |
| NL | 048053 | C | 3/1940 |

* cited by examiner

*Primary Examiner*—Mickey Yu
*Assistant Examiner*—Jerrold Johnson
(74) *Attorney, Agent, or Firm*—Matthew P. Fitzpatrick; Sarah Ann Dressel; Ken K. Patel

(57) ABSTRACT

The present invention relates to a package for compressible flat articles according to the preamble of claim 1. Moreover, the present invention is related to a method for filling such a package.

7 Claims, 3 Drawing Sheets

26
24
10
30
22
20
28
A
18
40
60
50
44
54
52
32
56
12
16
18
14
42
72

PACKAGE FOR COMPRESSIBLE FLAT ARTICLES

CROSS REFERENCE TO RELATED APPLICATION

This application is a continuation application of prior copending International Application No. PCT/2004/015322, filed May 13, 2004, designating the U.S.

FIELD OF THE INVENTION

The present invention relates to a package for compressible flat articles according to the preamble of claim 1. Moreover, the present invention is related to a method for filling such a package.

Packages of the above kind are known, for example, from document EP 0 585 653 A1, which is considered as the closest state of the art, and also from EP 0 406 928 B1, which shows a similar kind of package. The packages described by these documents are provided for receiving relatively soft and flexible compressible articles like, for example, disposable diapers, incontinent briefs and the like. To increase the number of articles to be received within a single package, said articles are arranged in a compressed stack in a way that they can be taken out through an opening, which is provided in a wall panel of the package. In recent times flexible packages or bags like side gusset packs made of a polymeric sheet material have been used for this purpose, as these packages combine the benefits of providing a high storage volume and low weight. Moreover, packages made from a sheet material can easily be disposed after use, which is advantageous under environmental aspects.

As the articles are individually used by the consumer, the opening in the wall panel should enable the user to take out the articles easily one by one, while the articles remaining inside the package should be prevented from being ejected out of the opening due to the pressure of the compressed stack. For this reason, EP 0 585 653 A1 proposes an opening with dimensions with respect to the remaining wall panel that allow an easy take-out but prevent the rest of the stack from being forced through the opening hole.

Because it is important to keep the integrity of the package during the transport, the opening is just defined by lines of weakness in this state, like, for example, a perforation, and before the first article can be taken out, the user has to open the package by removing an inner part of the wall by breaking the line of weakness to form an aperture in the wall panel. This construction offers the advantage that an unintentional opening during the transport of the package is prevented, but on the other hand this kind of opening is sometimes difficult to open for the user because it is sometimes hard to tear open the perforation. Moreover, when the opening is once opened after the first use, there is still the danger that the remaining stack of compressible articles deforms the package and tends to eject some of the articles out of the opening if the aperture is too wide. Consequently there are certain limitations concerning the dimensions and the form of the opening, as it has to be considered that the integrity of the package itself is partly destroyed by ripping off a part of the wall panel to form the opening. Especially if the user wants to transport the opened package from one place to another, it is not possible to close the opening for preventing the stored articles from being pressed out.

It is therefore an object of the present invention to provide a package of the above kind which can easily be opened, while an unintentional opening due to the pressure of the articles stores inside the package is prevented, especially during a transport of the package which has once been opened.

To comply with these objectives, a package of the above kind is characterized by the features of claim 1.

The opening of the package according to the present invention is provided with a cover element for closing the opening. This cover element comprises a bottom layer and a top layer. The bottom layer is formed by a portion of the wall panel which is at least partially removable from the wall panel itself, so that an aperture can be formed in the wall panel. The top layer adheres on said bottom layer and comprises a frame-like peripheral portion which projects over the periphery of said removable wall portion and detachably adheres to a surrounding portion of the wall panel which is disposed around the removable wall portion. That is, in the closed state the projecting peripheral portion of the top layer adheres on a frame-like surrounding portion which is part of the remaining, non-removable part of the wall panel.

Said removable wall portion comprises a first and a second portion, of which a first portion is provided to be removed before removing a second portion when the cover element is opened. This first portion represents an area of no force removal, and it can easily be removed from the surrounding wall portion. On the other hand, the following second portion of the removable wall portion is separated from the surrounding wall portion by at least one line of weakness, along which the removable wall portion can be separated at least partially from the surrounding wall portion by low force removal when the cover element is opened for the first time.

By this construction, a cover element is provided by which the opening of the package can be closed after once being opened to prevent the remaining articles from being ejected out of the package, so that the package according to the invention can be transported in a closed state. Before opening for the first time, the integrity of the wall panel comprising the opening is preserved, as the removable wall portion is at least partially connected with the surrounding wall portion along the lines of weakness, i.e., the removable wall portion is not completely separated from the surrounding portion in this state. However, the opening can easily be accomplished by the user because the first portion of the removable wall portion is easy to remove, while the following second portion can be removed along lines of weakness by exerting a comparatively low force. This combination of a first portion representing an area of no force removal and a second portion as an area of low force removal makes it easy for the user to form the opening. By providing the top layer which in part adheres to the remaining surrounding portion of the wall panel, the opening can easily be closed, e.g. for the purpose of transport. It is noted that the package according to the present invention can be produced with low cost effort.

The above mentioned and other features and objects of the present invention become more obvious from the following description of a preferred embodiment of the invention, with reference to the following accompanying drawings.

Figure 1:
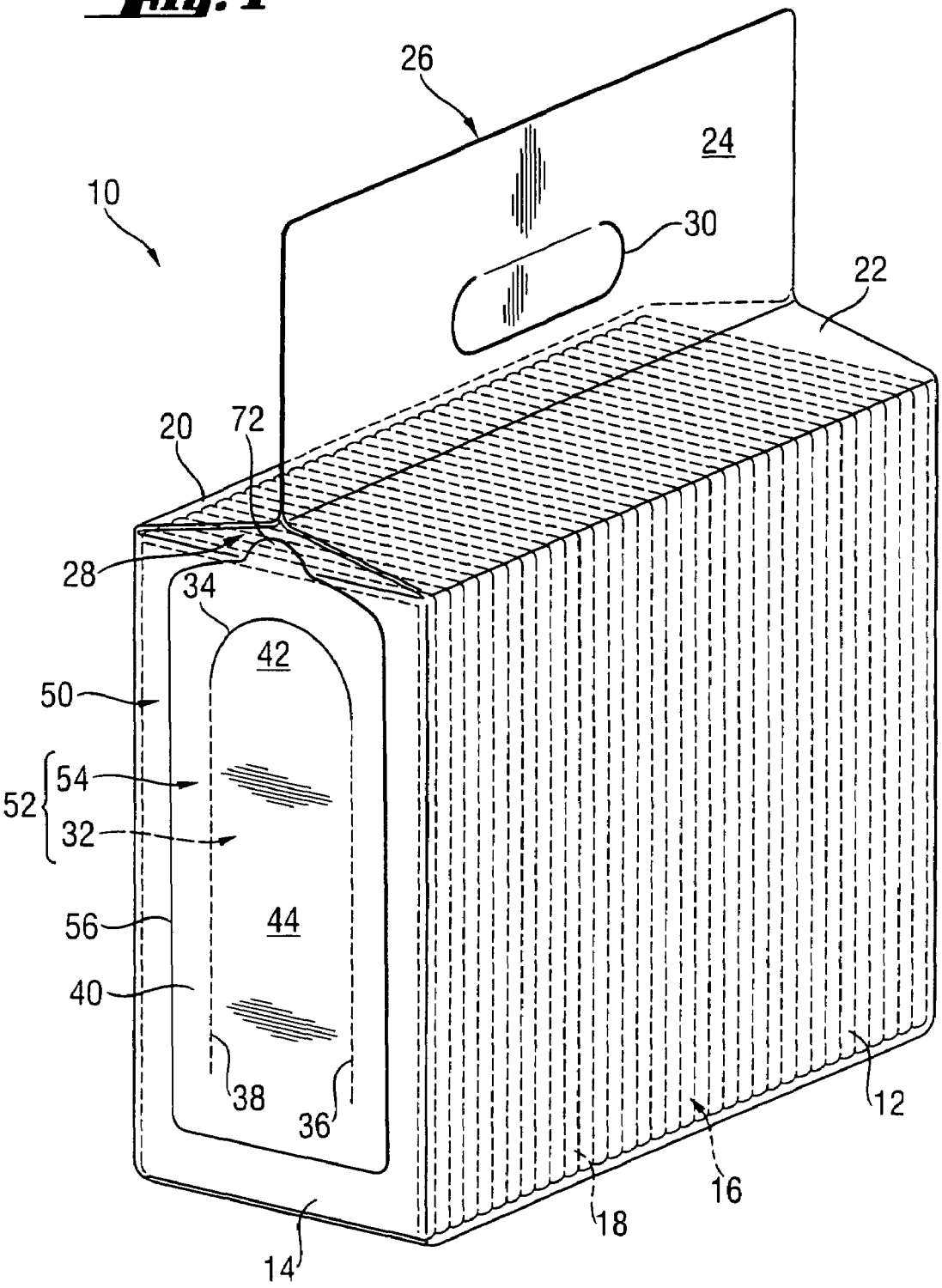
FIG. 1 shows a perspective view of a preferred embodiment of a package according to the present invention.

The package 10 as shown in FIG. 1 is made from a flexible polymeric sheet material and comprises opposing side wall panels 12, from which one side wall panel is not visible in FIG. 1, and opposing side wall panels 14 of smaller width which form the end walls of the package 10. These four side walls 12 and 14 enclose a parallelepiped space for receiving a stack 16 of diapers 18, which shall be described later. The top of the package 10 is closed by two symmetrical panel portions 20 and 22 which adjoin the opposing side panel portions 12 respectively, and the opposing surfaces of their upper end portions are connected to form a vertically extending portion 26 of the package 10, by which the package 10 is closed at its upper side. At its bottom, which is invisible in FIG. 1, the package 10 is closed by a similar connecting portion.

The upper ends of the side wall panels 14 are folded inwardly to form side gussets 28, which means that there are upper portions of the side panels 14 that extend towards the inner space of the package 10, their upper ends lying flat between the two panel portions 24 forming the upwardly extending portion 26. These portions of the side gussets 28 cannot be seen in FIG. 1. Under the aspect of the construction of a side gusset pack, this embodiment of the package 10 is very similar to the side gusset packs shown in EP 0 406 928.

The upwardly extending portion 26 comprises a slit 30 to form a recession or aperture which provides a hand grip for manually carrying the package 10.

Figure 2:
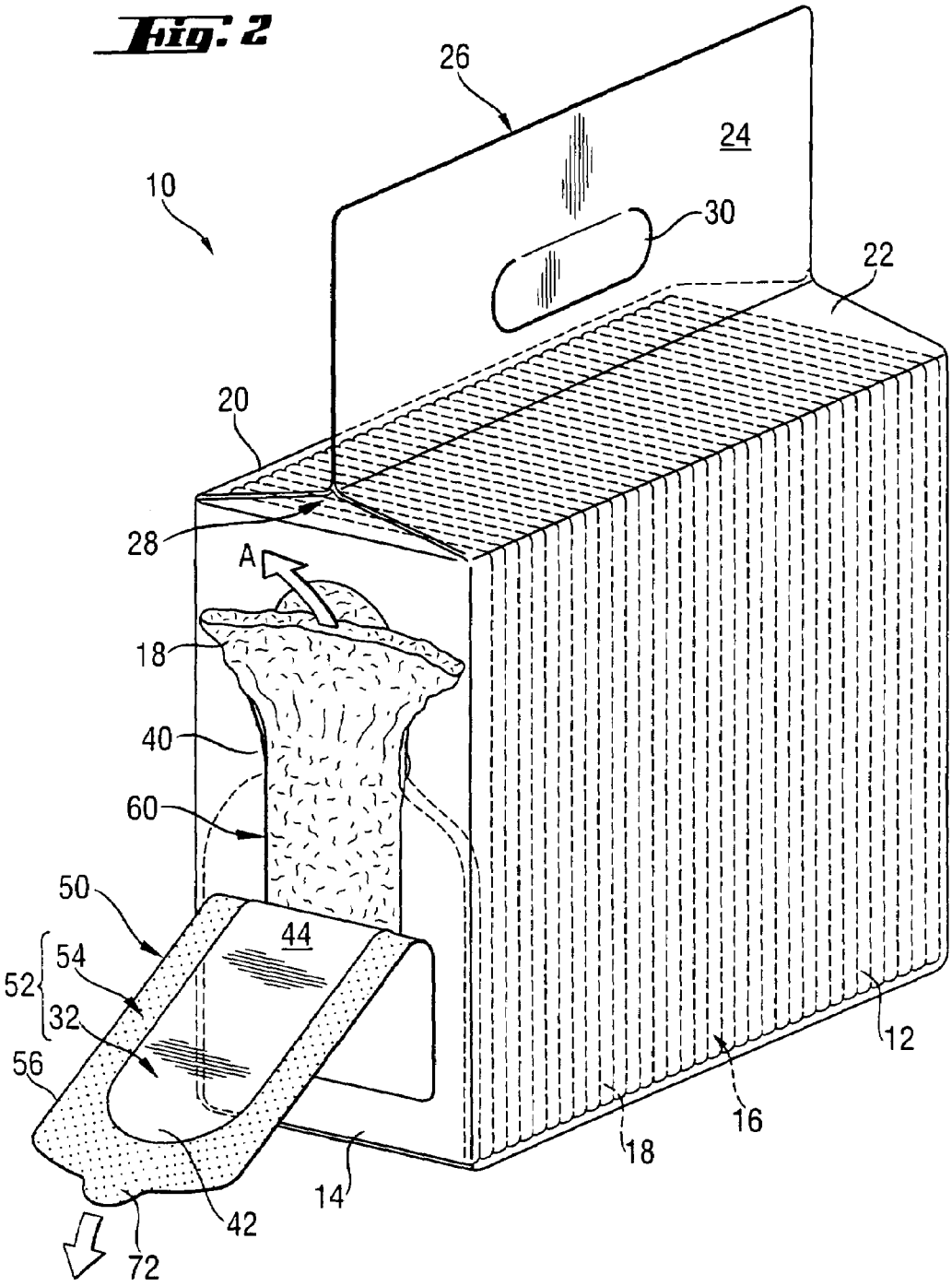
FIG. 2 is a view of the package according to FIG. 1, with the cover element in an opened state.

The wall panel 14 can be opened to take out the first diaper 18 on the left side of the stack 16. The diapers 18 are compressible flat articles that are typically folded one or more times in a direction generally parallel to the side walls 12,14 of the package 10. The diapers 18 are stacked inside the package 10 so that their surface is aligned substantially parallel to the wall panel 14 comprising the opening 60. To receive a large number of diapers 18 inside one package 10, the stack 16 is compressed. The positions of the diapers 18 forming the stack 16 in FIGS. 1 and 2 are indicated by stroked lines, as the diapers 18 are invisibly stored inside the package 10.

Said opening is provided by a removable wall portion 32 of the wall panel 14 which has the form of a tongue that extends vertically upward. More precisely, there is a continuously punched separation line 34 which has the form of an arc or semi-circle, and two parallel lines of perforation 34,36 are connected with the ends of this semi-circle 34 in a way that these three separation lines 34,36,38 join each other in form of an inversed letter U. This arrangement of separation lines 34,36,38 separates the tongue-like removable wall portion 32 from the surrounding portion 40 of the remaining wall panel 14.

While the arc-like punched separation line 34 surrounds the end 42 of the tongue 32, the remaining portion 44 of the tongue 32 is laterally limited by the two opposed lines of perforation 36,38. As the separation line 34 is continuously punched, it can be separated manually from the surrounding wall portion 40 by no force removal, while a low force is necessary to tear the second, remaining portion 44 of the tongue 32 out of the surrounding portion 40 along the lines of perforation 36,38. With other words, the end 42 of the tongue 32 forms a first portion of no force removal that is to be opened first, before removing the remaining portion 44 of the tongue 32 as a following second portion of low force removal during the opening procedure.

The removable wall portion 32 which has a form of a tongue represents a bottom layer of a cover element 50 for closing the opening of the package 10. A second part of this cover element 50 is formed by a sheet with the form of a flap 54 which is provided with a pressure sensitive adhesive layer, so that the flap 54 adheres to the tongue 32 and covers it completely. The dimensions of this flap 54 in its horizontal and vertical directions are such that a frame-like peripheral portion 56 of the flap 54 projects over the periphery of the tongue 32 and adheres on the surface of the surrounding portion 40 of the wall panel 14. So the flap 54 can be used to close the opening by folding the flap 54 together with the tongue 32 sticking on its inner surface upwardly so that the frame-like peripheral portion 56 of the flap 54 can detachably adhere on the surface of the surrounding portion 40. By this construction the opening can be closed for transporting the package 10 without the danger that the first of the diapers 18 of the stack 16 is ejected out of the package 10 due to the pressure of the compressed stack 16.

The end of the flap 54 comprises an adhesive-free end portion 72 for manually gripping the flap, which makes it easier for the user to seize the end portion of the flap 54.

FIG. 2 shows the package as described in connection with FIG. 1 in the opened state. The tongue-like removable wall portion 32 has been ripped open together with the flap 54 that adheres on the surface of the tongue 32, so that an opening 60 with a U-shaped outline is formed in the wall panel 14. This opening 60 allows the end user to take out the first of the diapers 18 of a stack 16 inside the package 10.

As the stack 16 is compressed, the first of the diapers 18 tends to be ejected out of the opening 60 by the pressure of the stack 16. The direction to take out the first diaper 18 is indicated by an arrow A in FIG. 2. After drawing the first diaper 18 out of the opening 60 in a vertical forward direction, the following diaper 18 will fill the opening or may be partly drawn out of the upper portion of the opening 60 so that the subsequent take-out operation is simplified. This is illustrated in FIG. 2, as the upper part of the shown first diaper 18 projects from the opening 60.

Figure 3:
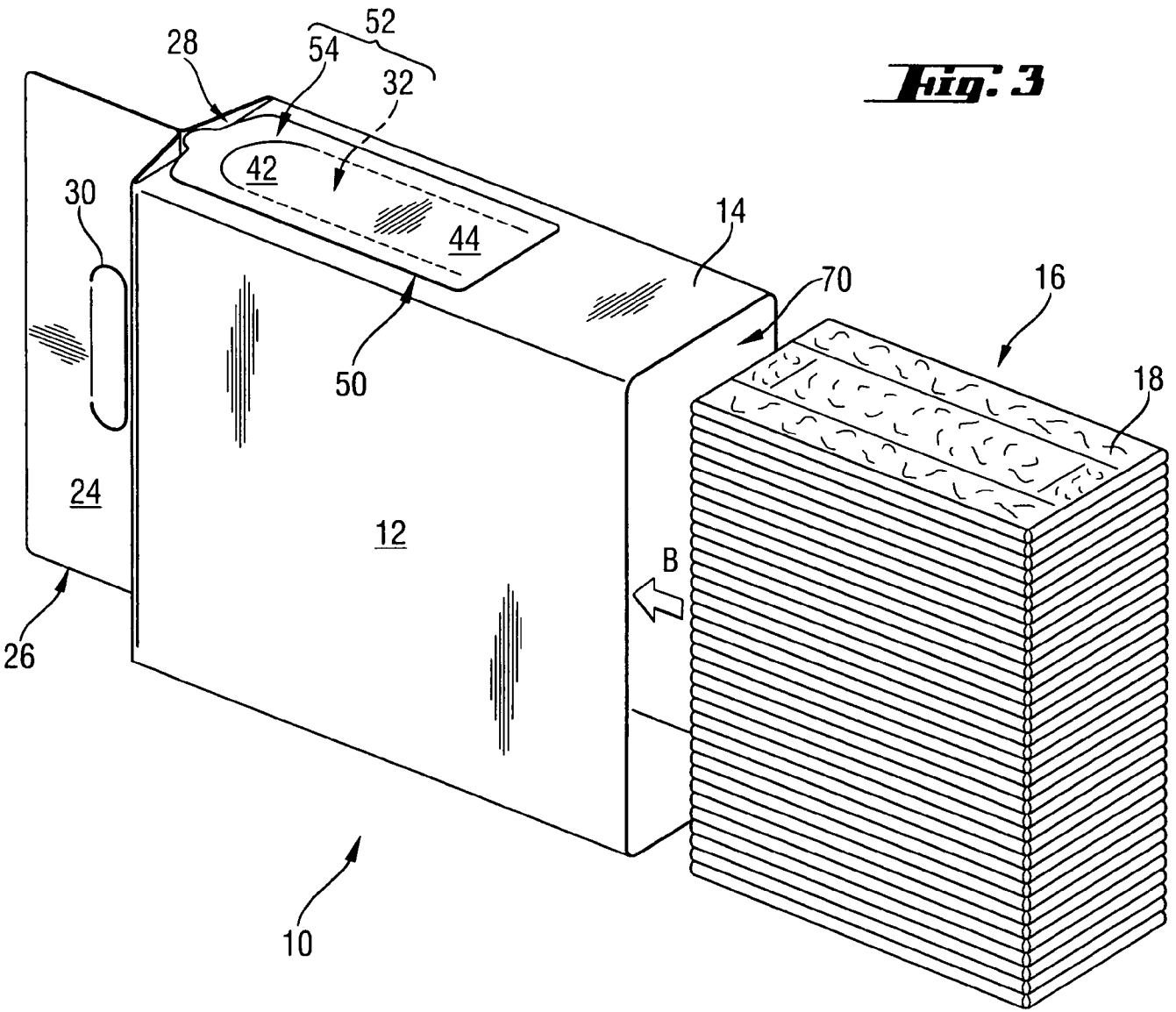
FIG. 3 is a view from another perspective to illustrate a filling method for a package according to the invention.

FIG. 3 illustrates a method for filling the package 10 as described in FIGS. 1 and 2 with the stack 16 of diapers 18 through an opening 70 in the bottom of the package 10. First, the stack 16 of diapers 18 is arranged and compressed, and the package 10 is formed completely with its side walls 12 and 14 from a polymeric sheet material. Before closing the bottom of the package 10, the complete stack 16 of diapers 18 is filled in. Because the stack 16 is to be compressed before being received by the containing space inside the package 10, the bottom is tented by a packaging machine or the like so that a rectangular opening 70 is formed. Then the compressed stack 16 of diapers 18 is pushed in the direction indicated by an arrow B through the bottom opening 70 inside the package 10 so that the package 10 is charged with the stack 16. It is understood that it is also possible to open the tented bottom 70 first and to form the compressed stack 16 afterwards, but it is essential to charge the package 10 with the complete compressed stack 16.

With the stack 16 inside, the package 10 is closed by connecting the opposed side panels 12 and by folding the lower ends of the wall panel 14 so that side gussets are formed like the side gussets 28 in FIG. 1.

What is claimed is:

1. A package of compressible folded diapers, said diapers being received by the package in a compressed form and arranged in a stack, said package comprising an opening in a side wall panel of the package for taking out the, diapers, said diapers being placed in said package with a major surface facing said opening and a folded portion of said diapers facing a bottom surface of said package, wherein the opening is provided with a cover element comprising two layers, with a bottom layer being formed by a portion of the wall panel which is at least partially removable from the wall panel, and a top layer adhering on said bottom layer, said top layer comprising a frame-like peripheral portion which projects over the periphery of said removable wall portion and detachably adheres to a surrounding portion of the wall panel disposed around the removable wall portion, wherein a first portion of said removable wall portion, which is to be opened first, is an area of no force removal, said first portion of said removable wall portion being separated from the surrounding wall portion by a continuously cut or punched separation line, while a following second portion is separated from the surrounding wall portion by at least one line of weakness, said line of weakness being provided as a line of perforations adjoining the separation line, wherein, the removable wall portion can be separated at least partially from the surrounding wall portion along said line of weakness by low force removal when opening the cover element for the first time, whereby when the top layer of the cover element is adhered to the wall panel, the cover element prevents the compressed diapers from being ejected out of the opening.

2. Package according to claim 1, wherein said removable wall portion is formed as a tongue and that said top layer is formed as a flap adhering to the tongue, said first portion of said removable wall portion being the end portion of said tongue, while the second portion of the tongue is laterally limited by two opposed lines of weakness for partially separating the tongue from the surrounding wall portion.

3. Package according to claim 2, wherein the flap is provided with an adhesive layer.

4. Package according to claim 3, wherein the adhesive is a pressure sensitive adhesive.

5. Package according to claim 3, wherein said flap comprises an adhesive-free end portion being provided for manually gripping the flap.

6. Package according to claim 1, wherein the package is made of a polymeric sheet material.

7. Package according to claim 6, wherein the package is a side gusset pack.

* * * * *

UNITED STATES PATENT AND TRADEMARK OFFICE

CERTIFICATE OF CORRECTION

PATENT NO. : 7,213,710 B2
APPLICATION NO. : 10/877542
DATED : May 8, 2007
INVENTOR(S) : Filiz Cotert It is certified that error appears in the above-identified patent and that said Letters Patent is hereby corrected as shown below:

Title Page

After the Related U.S. Application Data, insert:

(30) Foreign Application Priority Data

May 13, 2003 (EP) …….. 03010673

Signed and Sealed this

Twentieth Day of May, 2008

JON W. DUDAS
*Director of the United States Patent and Trademark Office*